United States Patent [19]

Matsumoto

[11] 4,136,872

[45] Jan. 30, 1979

[54] GAME EMPLOYING LIQUID MOVEMENT TO MOVE A PLAYING PIECE

[75] Inventor: Takao Matsumoto, Tokyo, Japan

[73] Assignee: Tomy Kogyo Co., Inc., Tokyo, Japan

[21] Appl. No.: 798,235

[22] Filed: May 18, 1977

[30] Foreign Application Priority Data

May 26, 1976 [JP] Japan ..... 51/67979[U]

[51] Int. Cl.[2] ..... A63F 7/06

[52] U.S. Cl. ..... 273/85 H; 273/1 L

[58] Field of Search ..... 273/85 H, 1 L, 119 B, 273/101; 46/44

[56] References Cited

U.S. PATENT DOCUMENTS

| | | | |
|---|---|---|---|
| 1,756,299 | 4/1930 | Owens | 273/85 H |
| 3,643,953 | 2/1972 | Fixler | 273/119 B |
| 3,711,097 | 1/1973 | Begley | 46/44 X |
| 3,781,010 | 12/1973 | Matsumoto | 273/85 C |
| 4,032,141 | 6/1977 | Tanimura | 273/1 L |

*Primary Examiner*—Anton O. Oechsle
*Attorney, Agent, or Firm*—Edward D. O'Brian

[57] ABSTRACT

A game capable of being played by two different persons can be constructed so as to employ a transparent housing serving to hold a fluid. A movable member having a specific gravity greater then the specific gravity of the fluid is located within the housing in the fluid. Two separate circulation structures are employed for circulating the fluid within the housing. Each of these circulation structures is capable of withdrawing fluid from within the interior of the housing and then ejecting the fluid back into the interior of the housing through a nozzle. The nozzles of the two circulation structures are located separate and apart from one another and are directed relative to one another so that the circulation structures are capable of being operated to cause currents within the housing for moving the movable member which vary and interfere with one another.

5 Claims, 2 Drawing Figures

GAME EMPLOYING LIQUID MOVEMENT TO MOVE A PLAYING PIECE

CROSS-REFERENCE TO RELATED APPLICATIONS

This application contains subject matter which is considered to constitute an improvement on the subject matter set forth and disclosed in the Tomihiro Tanimura U.S. patent application Ser. No. 665,323, filed Mar. 9, 1976, entitled "AMUSEMENT DEVICE," now U.S. Pat. No. 4,032,141 issued June 28, 1977.

BACKGROUND OF THE INVENTION

The invention set forth in this specification pertains to new and improved games employing fluid movement to move a playing piece.

In the past various so called "water" games have been constructed so as to utilize a transparent housing holding a fluid such as water containing one or more playing pieces having a specific density greater than the specific density of the water. Such games have utilized a pump or pump type mechanism attached to the housing for circulating the fluid in the housing in such a manner as to move the playing piece or pieces employed within the housing relative to one or more appropriate objectives, such as a series of holders for such playing pieces. Such holders are adapted to "capture" or hold the playing pieces as these games are used.

One common water game constructed as indicated in the preceding discussion has been formed so as to include a plurality of ball-type playing pieces which are adapted to be temporarily lodged in a series of holders more or less corresponding to the spaces used in the well known game of "Tic, Tac, Toe." Other water games constructed as indicated in the preceding have utilized ring type game pieces which are adapted to be located over projections serving as holders which accumulate playing pieces as the game is played. Other similar related constructions have been previously proposed and/or used.

Although all of such prior water games are considered to be highly desirable for play purposes as amusement devices they are nevertheless considered to be somewhat limited in application because they have been constructed in such a manner as to be capable of being utilized by only a single individual. For many types of play purposes it is desired to utilize a game which can be played by two individuals since the competitive aspects of a game capable of being played by two individuals are highly beneficial to play acceptability. As a result of the noted limitation of the prior water games it is considered that there is a need for new and improved water or similar fluid type games which are capable of being played by two separate individuals.

BRIEF SUMMARY OF THE INVENTION

A broad objective of the present invention is to provide such new and improved games. More specifically an object of the present invention is to provide new and improved games employing fluid movement to move a playing piece which are capable of being utilized by two individuals in such a manner that the way in which each of the individuals utilizes the game has a profound or significant effect on the action achieved within the game. Further objectives of the present invention are to provide new and improved games employing fluid movement to move a playing piece which can be constructed so as to effectively simulate well established adult games such as basketball, soccer and the like. Other objectives of the invention are to provide games as indicated which may be easily and conveniently constructed at a comparatively nominal cost, which may be easily and conveniently played by either one or two individuals, and which have a significant degree of play value.

In accordance with this invention these objectives are achieved by providing a game having a transparent housing, a fluid located within said housing, a movable member having a specific gravity greater than the specific gravity of the fluid located within said housing in said fluid, and means for circulating said fluid within said housing so as to move said movable member in which the improvement comprises: said game having two of said circulation means, each of said circulation means being capable of being independently operated so as to remove fluid from the interior of said housing and so as to eject a stream of fluid into the interior of said housing, each of said circulation means having a nozzle directed into the interior of said housing for ejecting a stream of said fluid into the interior of said housing, said nozzles being located separate and apart from one another and being located relative to one another so that said circulation means are capable of being operated to cause currents within said housing for moving said movable members which vary and which interfere with one another.

BRIEF DESCRIPTION OF THE DRAWING

Because of the nature of this invention it is best more fully described with reference to the accompanying drawing in which.

Figure 1:
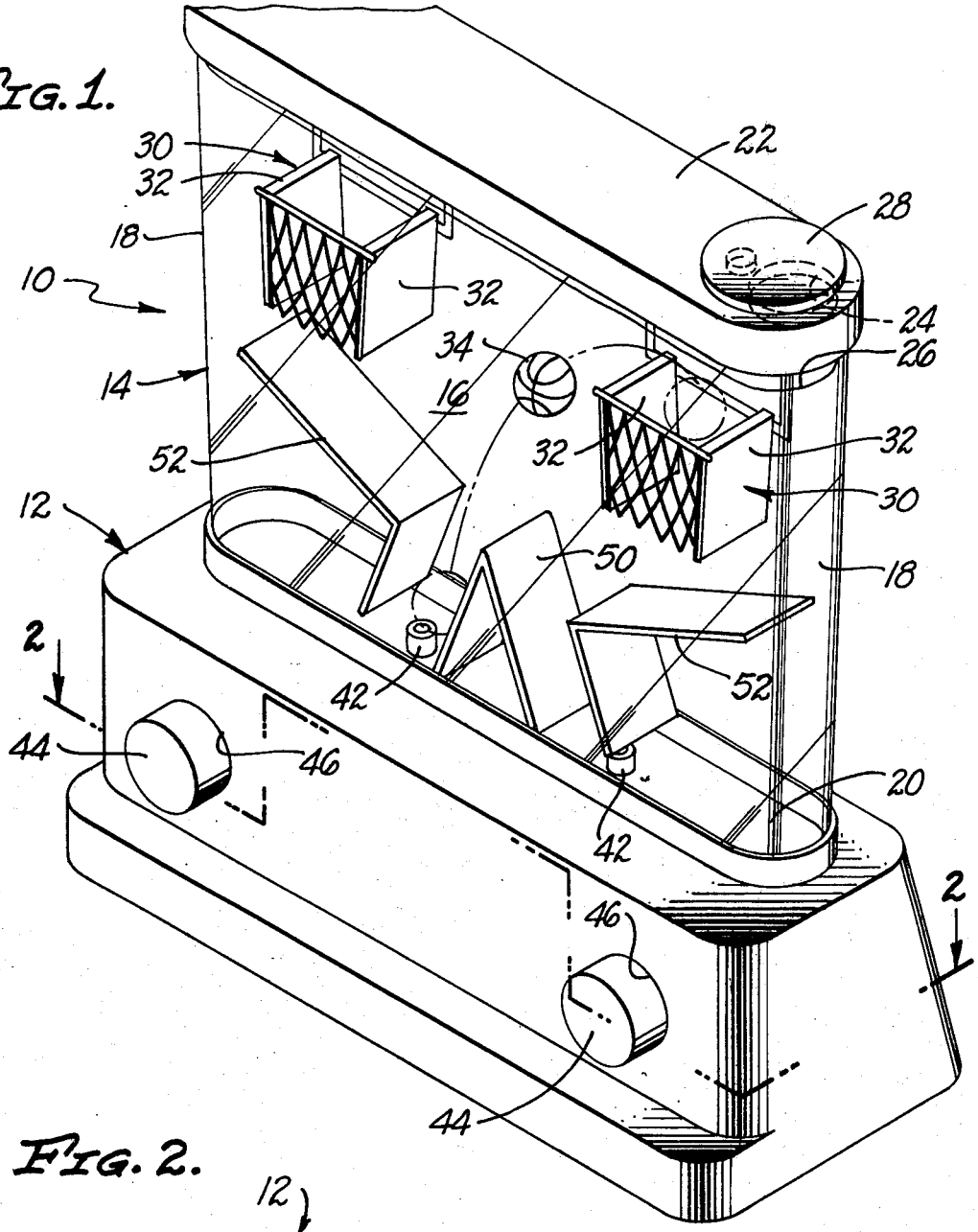
FIG. 1 is an isometric view of a presently preferred embodiment or form of a game in accordance with this invention which to a degree effectively simulates the well known game of basketball.
Figure 2:
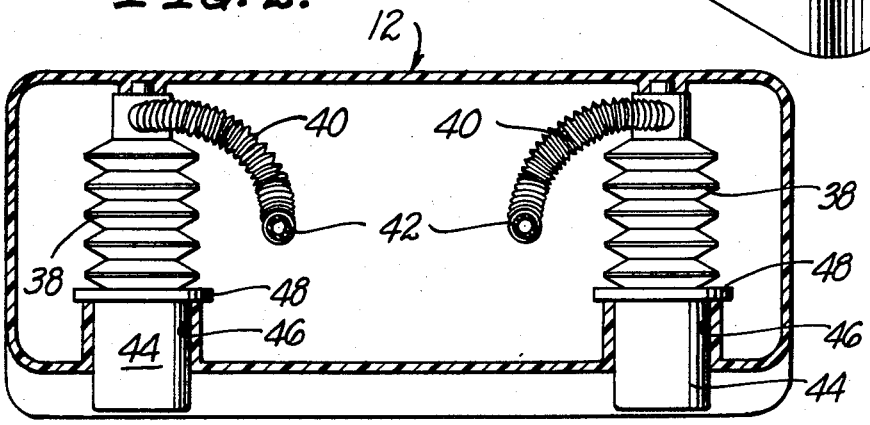
FIG. 2 is a cross-sectional view taken at line 2—2 of FIG. 1 illustrating certain operative parts of this game.

It will be realized that the principles or features of the invention set forth and defined in the appended claims can be easily utilized in connection with a number of somewhat differently constructed and somewhat differently appearing games which differ from the specific game illustrated as to various details within the scope of routine design and/or engineering skill. For this reason, the invention set forth herein is not to be considered as being limited to a game constructed precisely as illustrated in the accompanying drawing.

DETAILED DESCRIPTION

In the drawing there is shown a game 10 as indicated in the preceding which is constructed so as to include an opague, hollow base 12 serving to support an upstanding transparent housing 14 having flat, parallel sides 16 joined by ends 18 and a bottom 20. The bottom 20 is also the top of the base 12. Preferably a lid 22 is located on the housing 14 remote from the bottom 20 so as to be capable of closing off the interior of this housing 14. It is considered preferable to locate an opening 24 in the lid 22 for use in filling the interior of the housing 14 with an appropriate fluid such as water 26. A conventional closure 28 is utilized for the purpose of sealing off the opening 24.

The housing 14 includes two different goals 30, each of which is intended to simulate a basket in the game of basketball. Each of these goals 30 includes two spaced, parallel cross walls 32 extending between and attached to the sides 16 adjacent to the lid 22. The water 26 in the housing 14 preferably covers the goals 30 to a sufficient extent so that a small movable member or game piece 34 constructed so as to simulate a basketball can be circulated within the water 26 in the housing 14 so as to pass vertically downward through the two goals 30. In order to achieve the mode of operation desired for the game 10 this ball 34 has a specific gravity greater than the specific gravity of the water 26 used in the game 10. Preferably the ball 34 should not have a significantly greater specific gravity than the water 26 so that it will move easily throughout the interior of the housing 14 as the water 26 within this housing 14 is moved.

In accordance with this invention two different circulating means (not separately numbered) are utilized for moving the water 26. Each of these circulating means includes a bellows 38 serving as a collapsible chamber which is connected by means of a corregated tube 40 to a nozzle 42 leading through the bottom 20 into the interior of the housing 14. Each of the bellows 38 is adapted to be compressed by an individual pushing upon an actuating button 44 located so as to extend from the exterior (not numbered) into the interior (not numbered) of the base 12 through an opening 46 in this base 12. The openings 46 in this base 12 serve as bearings so as to guide the movements of the buttons 44. These buttons 44 are provided with interior flanges 48 which abut against the interior of the base 12 so as to limit outward movement of the buttons 44 when the bellows 38 are fully expanded.

These bellows 38 are preferably formed out of a somewhat resilient material in such a manner that they will normally return to an expanded position as shown after the buttons 44 are actuated. In order to insure proper operation of the game 10 it is preferred to form these bellows 38 so that they are sufficiently flexible so as to be capable of expanding that the weight of the water 26 in the housing 14 will independently hold them in an expanded position as indicated. Further, it is preferable to form the tubes 40 of a corregated, somewhat resilient material such as polyethylene or the like, which will change in configuration as pressure is applied internally so that these tubes to a degree tend to act as accumulators as the game 10 is operated.

With the described structure the goals 30 are located adjacent to, but spaced from, the ends 18 and are located equidistant from a point (not shown) toward which both of the nozzles 42 are directed. This point is located midway between the sides 16 and midway between the ends 18 above the bottom 20 so as to be generally above an upwardly directed V-shaped divider 50 separating the nozzles 42. With this structure it is possible for different players to independently and separately push inwardly upon the buttons 44 at different rates to create streams of water which tend to intersect one another and interact with one another at about the common point noted in the preceding so as to cause the entire water 26 within the housing 14 to circulate.

The manner of such circulation will depend upon the manner in which the buttons 44 are actuated. As used herein the term "actuated" is utilized in a broad sense so as to include both the manner in which pressure is applied to and released from such buttons. As the buttons 44 are allowed to move outwardly so as to permit expansion of the bellows 38 water will be drawn into these bellows 38 through the nozzles 42 and this will in turn effect movement of the water 26 within the housing 14.

As a result of such interaction of currents of water either into or out of the nozzles 42 two different players can compete against one another so as to cause the ball 34 to move into and through a goal 30 associated with either of the buttons 44 in a sense that it is located immediately above it. In essence, an action can be achieved within the housing 14 which corresponds to the action of shooting a basket in the conventional game of basketball.

As the ball 34 is circulated within the housing 14 generally toward either of the ends 18 it is possible to avoid the ball 34 from ever passing out of play by settling in a quiescent zone or area within the housing 14 by utilizing baffles 52 which tend to direct the ball 34 back to where it will be contacted by a stream emitted from one or both of the nozzles 42. These baffles 52 generally slope downwardly from the ends 18 and are supported by the sides 16.

In order to promote significant circulation within the housing 14 preferably these baffles 52 are spaced from the ends 18 and the bottom 20. This allows a stream of fluid from a nozzle 42 to tend to pull in fluid from adjacent to the ends 18 in accordance with Bernoulli's principle as streams are ejected from the nozzles 42. Other baffles (not shown) may be located within the housing 14 to obtain specialized flow effects.

It is believed it will be apparent from the preceding that the game 10 is a simple, easily constructed, effective structure which may be utilized by two individuals for play purposes. This game is, of course, capable of being utilized by a single individual who operates the two buttons 44 with his or her hands so as to effectively play against himself or herself. These buttons 44 in effect act as actuators for circulation structures or means as described consisting of the bellows 38, the tubes 40 and the nozzles 42. Other equivalent pump or pump-like structures can be employed either with or without separate fluid inlets from the housing 14. The particular pump-like structure shown is considered to be preferable because of its simplicity and effectiveness.

I claim:

1. A game having a transparent housing, a liquid located within said housing, a movable member having a specific gravity greater than the specific gravity of said liquid located within said housing in said liquid, and means for circulating said liquid within said housing so as to move said movable member in which the improvement comprises:

said game having two of said circulation means, each of said circulation means being capable of being independently operated so as to remove liquid from the interior of said housing and so as to eject a stream of said liquid into the interior of said housing at variable rates, each of said circulation means having a nozzle directed into the interior of said housing for ejecting a stream of said liquid into the interior of said housing, said nozzles being located separate and apart from one another and being located relative to one another so that said circulation means are capable of being operated to cause currents within said housing for moving said movable member which vary and which interfere with one another, said nozzles being directed to a common point within said housing, two separate goal means located within said housing, one of said goal means being associated with one of said circulation means and the other of said goal means being associated with the other of said circulation means, each of said goals being a simulated basket through which said movable member is capable of passing and wherein said movable member is a simulated basketball, said simulated baskets being located so as to be spaced from one another above the bottom of said housing.

2. A game as claimed in claim 1 wherein:

said housing is shaped so that said member will be automatically moved by gravity to an area within said housing in which it can be engaged by liquid ejected into the interior of said housing from at least one of said nozzles.

3. A game as claimed in claim 1 wherein:

each of said circulation means includes in addition to a nozzle a collapsible chamber means having a single outlet connected to the nozzle forming a part thereof.

4. A game as claimed in claim 1 including:

said housing is shaped so that said member will be automatically moved by gravity to an area within said housing in which it can be engaged by liquid ejected into the interior of said housing from at least one of said nozzles, each of said circulation means includes in addition to a nozzle a collapsible chamber means having a single outlet connected to the nozzle forming a part thereof.

5. A game having a transparent housing, a liquid located within said housing, a movable member having a specific gravity greater than the specific gravity of said liquid located within said housing in said liquid, and means for circulating said liquid within said housing so as to move said movable member in which the improvement comprises:

said game having two of said circulation means, each of said circulation means being capable of being independently operated so as to remove liquid from the interior of said housing and so as to eject a stream of said liquid into the interior of said housing at variable rates, each of said circulation means having a nozzle directed into the interior of said housing for ejecting a stream of said liquid into the interior of the housing, said nozzles being located separate and apart from one another and being located relative to one another so that said circulation means are capable of being operated to cause currents within said housing for moving said movable member which vary and which interfere with one another, and wherein said housing is an elongated, flat housing having spaced, parallel sides, ends connecting said sides and a bottom connecting said sides and said ends, said nozzles are directed to a common point within said housing above said bottom thereof and midway between said ends, said movable member is a simulated basketball, said game including two simulated basket goals through which said movable member is capable of passing in a vertical direction, said basket goals being located adjacent to the top of said housing and adjacent to said ends, said basket goals being equidistant from said common point, means located within said housing for deflecting said movable member to where it is capable of being engaged by at least a stream of liquid ejected through one of said nozzles, said nozzle means extend into the bottom of said housing, each of said circulation means includes in addition to a nozzle a bellows capable of expanding and contracting and an actuation means for causing a change in the configuration of said bellows, the bellows within each of said circulation means being connected to the nozzle within such circulation means so that liquid may be ejected into and withdrawn from said housing through said nozzle.

* * * * *